United States Patent [19]

Browning

[11] 4,019,335

[45] Apr. 26, 1977

[54] HYDRAULICALLY ACTUATED SPLIT STIRLING CYCLE REFRIGERATOR

[75] Inventor: Calvin W. Browning, Torrance, Calif.

[73] Assignee: The Garrett Corporation, Los Angeles, Calif.

[22] Filed: Jan. 12, 1976

[21] Appl. No.: 648,432

[52] U.S. Cl. ..... 62/6

[51] Int. Cl.[2] ..... F25B 9/00

[58] Field of Search ..... 62/6

[56] References Cited

UNITED STATES PATENTS

| | | | |
|---|---|---|---|
| 1,240,862 | 9/1917 | Lundgaard | 62/6 |
| 3,368,360 | 2/1968 | Daly et al. | 62/6 |
| 3,400,281 | 9/1968 | Malik | 62/6 |
| 3,530,681 | 9/1970 | Dehne | 62/6 |
| 3,535,872 | 10/1970 | Kelly | 62/6 |
| 3,604,821 | 9/1971 | Martini | 62/6 |
| 3,650,118 | 3/1972 | O'Neil | 62/6 |
| 3,765,187 | 10/1973 | Horn | 62/6 |
| 3,802,211 | 4/1974 | Bamberg | 62/6 |
| 3,913,339 | 10/1975 | Berry | 62/6 |

*Primary Examiner*—Lloyd L. King
*Attorney, Agent, or Firm*—Jack D. Puffer; Albert J. Miller

[57] ABSTRACT

A hydraulic displacing device actuates a diaphragm pump which provides pressure pulses in the cycle fluid of a split Stirling cycle machine. The pressure pulses are used in the actuation of a free piston cryogenic cooling device by causing the piston to alternately compress and expand the cycle gas.

18 Claims, 3 Drawing Figures

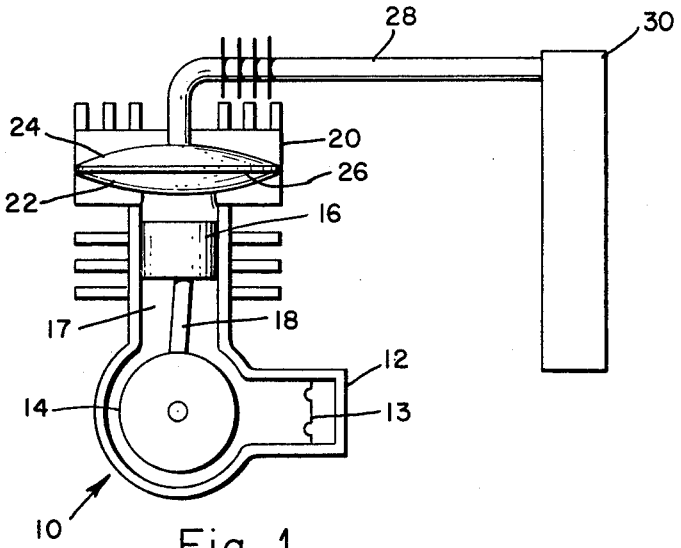
Fig. 1.
Fig. 3.
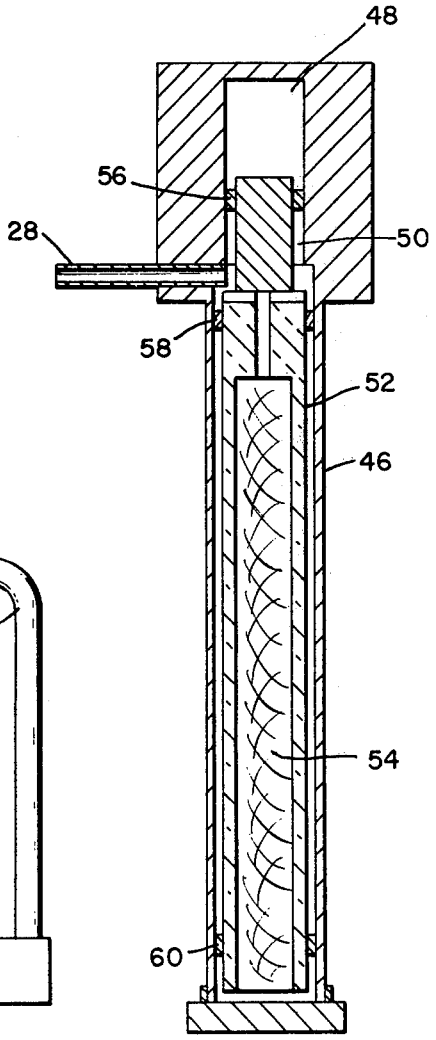
Fig. 2.
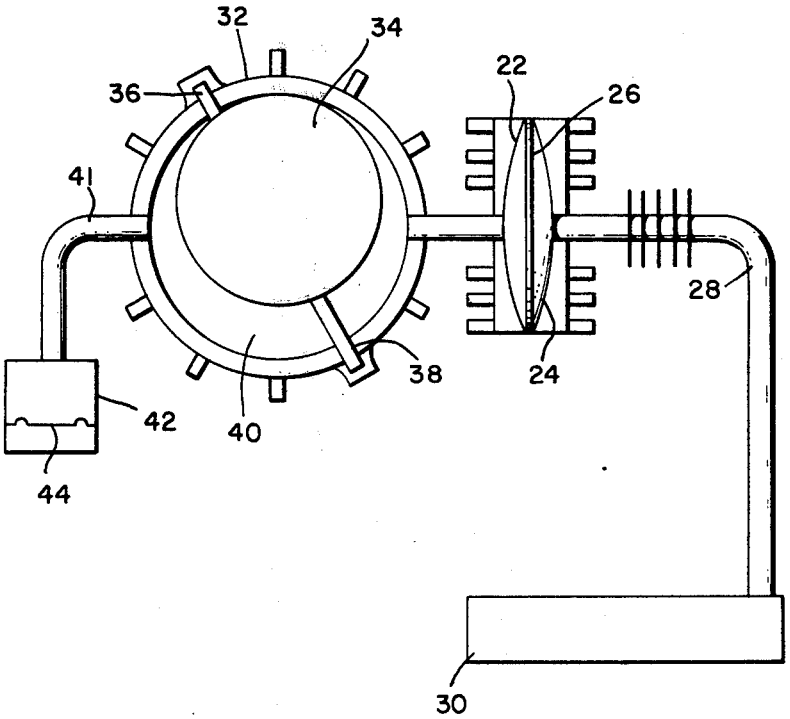

HYDRAULICALLY ACTUATED SPLIT STIRLING CYCLE REFRIGERATOR

BACKGROUND OF THE INVENTION

This invention relates to Stirling cycle refrigerators in general and in particular to split Stirling cycle refrigerators used to provide cryogenic cooling.

In devices of this type, one of the principal problems of the prior art has been to isolate the cycle fluid from contamination sources generally associated with the driving mechanism of the device. For example, if a piston is used for displacing the cycle fluid the material used for lubricating the piston in its cylinder will generally contaminate the cycle fluid. Likewise where the activating device is a pneumatic device the driving fluid must be effectively sealed from the cycle fluid to prevent contamination. Still other devices have attempted to solve this problem through the use of a bellows which is cyclically compressed and expanded by means of a mechanical driving device. Such a device is disclosed in U.S. Pat. No. 3,765,187. While the bellows device provides an effective seal for the cycle fluid compartment, the bellows often demonstrate a short life under the extreme cyclical conditions and frequently provide reliability problems because of the difficulty in maintaining fluid integrity of the bellows. Thus prior art devices have suffered from contamination problems or reliability problems which have limited the applicability of such devices.

SUMMARY OF THE INVENTION

The invention disclosed herein overcomes the disadvantages of the prior art devices by providing a simple diaphragm seal between the cycle fluid chambers and the driving mechanism. There is provided a displacer mechanism, either of the piston type or rotary type, which is used to displace a hydraulic fluid contained in a chamber and to force it against the exterior surface of the separation diaphragm. As the diaphragm is deformed upwardly the refrigeration fluid on the other side of the diaphragm is forced through a conduit to a free piston expander of the well known type. As the hydraulic displacer is moved in the opposite direction the diaphragm is released to move downwardly by its own resilience thus reversing the flow of the refrigeration fluid, allowing expansion in the free piston expander which provides the cooling effect.

Thus this invention provides a simple reliable seal means for the refrigeration fluid, and the driving motion is applied to the fluid by means of hydraulic displacers.

DESCRIPTION OF THE DRAWINGS

In the drawings:

FIG. 1 is a partial section of the system using a piston displacer;

FIG. 2 is a partial section of the system utilizing a rotary displacer device;

FIG. 3 is a sectional view through the free piston expander.

DESCRIPTION OF THE PREFERRED EMBODIMENT

Referring now to FIG. 1, there is shown generally at 10 a partial sectional view of the system. There is provided a pump housing 12 and a crankshaft 14 mounted for rotation therein. The crankshaft is connected to a piston 16 within a cylinder portion 17 of the housing by means of a connecting rod 18 in the well known manner. Adjacent to the piston housing there is provided a diaphragm housing 20 which divides the housing into a driving fluid chamber 22 and a cycle fluid chamber 24 by means of a diaphragm 26. The upper chamber 24 is connected by means of conduit 28 to a regenerative free piston expander shown generally at 30 and which will subsequently be described in more detail.

Referring now to FIG. 2, there is shown a schematic partial section of the same system which is powered by a rotary displacer. The rotary displacer is of a well known type having a housing 32 in which there is provided a rotor 34 carrying two vanes 36 and 38 on opposite sides of the rotor. The chamber 40 is connected by a conduit 41 to a fluid reservoir generally shown at 42 having an expansion diaphragm 44 therein. As was described in connection with FIG. 1 above, the displacer is connected to a diaphragm chamber which by means of a conduit is connected to a free piston expander.

Referring now to FIG. 3, there is shown a free piston expander of a type generally known in the art. The expander consists of a housing 46 which is divided into two chambers 48 and 50. Within the chamber 50 there is provided a free piston 52 having a hollow center opening in which there is provided a metallic mesh 54 for regeneration function which will be described later. The upper and lower chambers are separated by means of a seal 56 and seals 58 and 60 provide a seal between the inner and outer surfaces of the free piston.

OPERATION OF THE DEVICE

In operation the hydraulic displacer generates pressure pulses in the diaphragm chamber 22 by alternately displacing the hydraulic fluid in and out of the chamber. These pressure pulses cause the diaphragm 26 to move up and down within the chamber. As the diaphragm moves, the cycle fluid is pumped through conduit 28 and into the cylinder containing the free piston. As the pressure increases on the cycle fluid, the piston 52 is forced upward against the chamber 48. The chamber 48 contains cycle fluid by virtue of small leakage around the seal 56. After a few cycles the pressure established in chamber 48 is generally the average pressure of the cycle. Thus as the piston is forced upward by the increasing pressure of the cycle fluid, the cycle fluid at the bottom of the cylinder is expanded and thus substantially cooled. As the cycle pressure begins to decrease the pressure in chamber 48 exceeds that in the piston chamber and the piston then moves downward and the gas at the bottom of the chamber is forced up through the mesh 54 resulting in the regenerative action as the gas flows out of the chamber.

Thus it can be seen by those skilled in the art that through the use of a hydraulic displacer for driving a diaphragm pump the Stirling refrigeration action is allowed to take place with no danger of contamination from outside the cycle boundaries. In addition the diaphragm pump utilizes well known reliable components and simple displacer mechanisms to achieve an inexpensive, highly reliable system free of the problems of the prior art.

While specific embodiments of the invention have been illustrated and described, it is to be understood that these embodiments are provided by way of example only and that the invention is not to be construed as being limited thereto but only by the proper scope of the following claims:

What is claimed is:

1. A fluid handling system comprising:

pump means having first and second fluid tight chambers;

resilient wall means in said pump means for separating said chambers;

hydraulic displacing means connected to one of the chambers of said pump means and a source of hydraulic fluid for periodically deflecting said resilient wall means by displacement of said fluid;

fluid compressing means connected to the other chamber of said pump means and a second source of fluid whereby periodic deflection of said wall means by said displacing means causes periodic compression of said second fluid.

2. The fluid handling system according to claim 1 wherein said resilient wall means is a diaphragm means.

3. The fluid handling system according to claim 2 wherein said displacing means is a reciprocating piston displacing means.

4. The fluid handling system according to claim 2 wherein said displacing means is a rotary vane displacing means.

5. The fluid handling system according to claim 2 wherein said second fluid is a refrigeration fluid and said compressor means is a refrigeration compressor.

6. The fluid handling system according to claim 5 wherein said refrigeration compressor is a free piston compressor.

7. The fluid handling system according to claim 6 wherein said refrigeration compressor is a Stirling cycle compressor.

8. The fluid handling system according to claim 7 wherein said Stirling cycle compressor is a regenerative compressor.

9. The fluid handling system according to claim 8 wherein said displacing means is a reciprocating piston displacing means.

10. The fluid handling system according to claim 8 wherein said displacing means is a rotary vane displacing means.

11. In combination:

a source of hydraulic fluid;

a source of compressible fluid;

a diaphragm pump, said diaphragm dividing said pump into two fluid type chambers;

a hydraulic fluid displacing means connected to a source of hydraulic fluid and to one of the chambers of said pump for periodically deflecting said diaphragm;

a fluid compressor connected to a source of compressible fluid and to the other chamber of said pump whereby periodic deflection of said diaphragm causes periodic compression of said compressible fluid.

12. The combination according to claim 11 wherein said compressor means is a refrigeration compressor.

13. The combination according to claim 12 wherein said refrigeration compressor is a free piston compressor.

14. The combination according to claim 13 wherein said free piston compressor is a Stirling cycle compressor.

15. The combination according to claim 14 wherein said displacing means is a reciprocating piston displacing means.

16. The combination according to claim 14 wherein said displacing means is a rotary vane displacing means.

17. The method of operating a fluid system having one compressible fluid and one incompressible fluid, said fluids being separated by a fluid impervious resilient member, the steps of said method comprising:

displacing said incompressible fluid toward said resilient member;

deflecting said resilient member by displacement of said incompressible fluid;

compressing said compressible fluid by deflection of said resilient member.

18. The method according to claim 17 wherein the deflecting of said resilient member is a periodic deflection whereby said compressible fluid is alternately compressed and expanded.

* * * * *